US007653337B2

(12) United States Patent
Maeda et al.

(10) Patent No.: US 7,653,337 B2
(45) Date of Patent: Jan. 26, 2010

(54) IMAGE FORMING APPARATUS AND IMAGE FORMING METHOD

(75) Inventors: Yoritsugu Maeda, Toride (JP); Takashi Fujimori, Moriya (JP); Satoru Kanno, Kashiwa (JP)

(73) Assignee: Canon Kabushiki Kaisha (JP)

( * ) Notice: Subject to any disclaimer, the term of this patent is extended or adjusted under 35 U.S.C. 154(b) by 147 days.

(21) Appl. No.: 11/762,395

(22) Filed: Jun. 13, 2007

(65) Prior Publication Data

US 2007/0292171 A1 Dec. 20, 2007

(30) Foreign Application Priority Data

Jun. 14, 2006 (JP) ..... 2006-165062

(51) Int. Cl.
*G03G 15/01* (2006.01)
*G03G 15/00* (2006.01)

(52) U.S. Cl. ..... 399/301; 399/72; 399/231; 399/372

(58) Field of Classification Search ..... 399/301, 399/372, 72, 231
See application file for complete search history.

(56) References Cited

U.S. PATENT DOCUMENTS 6,295,435 B1 * 9/2001 Shinohara et al. ..... 399/301
6,349,185 B1 * 2/2002 Burkes et al. ..... 399/49
6,519,425 B2 * 2/2003 Fischer ..... 399/49
6,714,224 B2 * 3/2004 Yamanaka et al. ..... 347/116
6,744,997 B2 * 6/2004 Burkes et al. ..... 399/72
2005/0041990 A1 * 2/2005 Sugiyama ..... 399/49
2005/0047834 A1 * 3/2005 Tomita et al. ..... 399/301
2005/0238372 A1 * 10/2005 Shinohara et al. ..... 399/44
2006/0024076 A1 * 2/2006 Kato et al. ..... 399/49
2006/0045577 A1 * 3/2006 Maeda ..... 399/301
2006/0120772 A1 * 6/2006 Kitazawa et al. ..... 399/301
2006/0285863 A1 * 12/2006 Noguchi et al. ..... 399/49

FOREIGN PATENT DOCUMENTS

JP 2603254 B2 1/1997
JP 9-314911 A 12/1997

* cited by examiner

*Primary Examiner*—David M Gray
*Assistant Examiner*—Rodney Bonnette
(74) *Attorney, Agent, or Firm*—Rossi, Kimms & McDowell LLP

(57) ABSTRACT

An image forming apparatus capable of carrying out color misregistration correction at an appropriate time and providing a high-quality image free from color misregistration. A toner image is formed on the basis of an input image information signal. A width of the toner image is determined on the basis of the input image information signal, before forming the toner image in a predetermined area. The width of the toner image formed in the predetermined area is detected. The detected width of the toner image is compared with the determined width of the toner image. It is judged on the basis of the comparison result whether or not color misregistration is present.

20 Claims, 18 Drawing Sheets

SENSOR READING DIRECTION

FIG. 8A
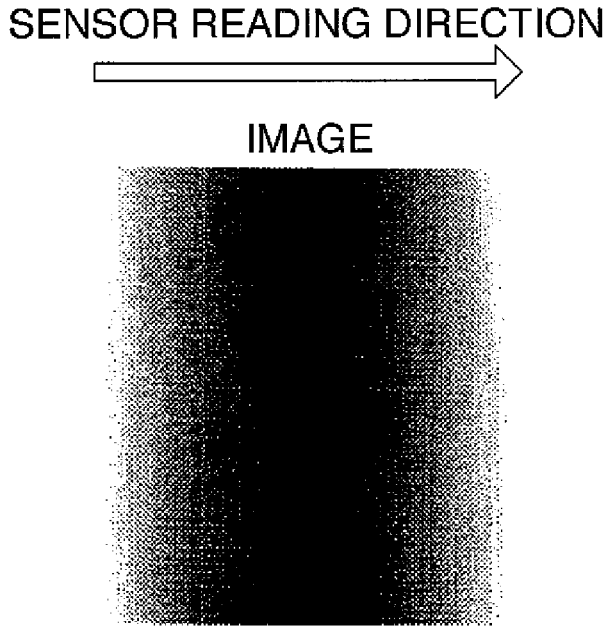
FIG. 8B
IMAGE DATA (VIDEO COUNT)
| | | | | | | |
|---|---|---|---|---|---|---|
| 10 | 40 | 80 | 100 | 70 | 40 | 10 |
| 10 | 40 | 80 | 100 | 80 | 40 | 10 |
| 10 | 40 | 80 | 100 | 80 | 40 | 10 |
| 10 | 40 | 80 | 100 | 80 | 40 | 10 |
| 10 | 40 | 80 | 100 | 80 | 40 | 10 |
| 10 | 40 | 80 | 100 | 80 | 40 | 10 |
| 10 | 40 | 80 | 100 | 80 | 40 | 10 |
FIG. 8C
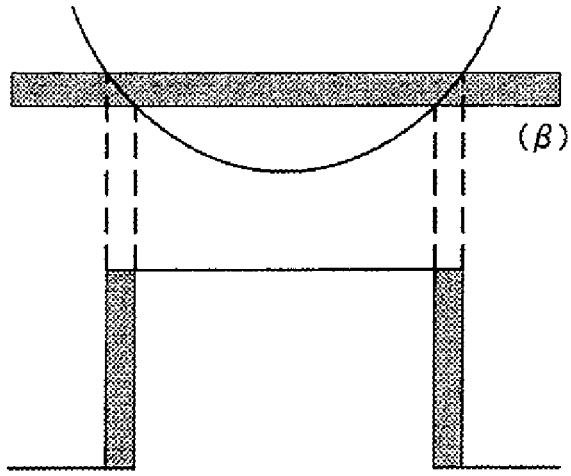

FIG. 8D
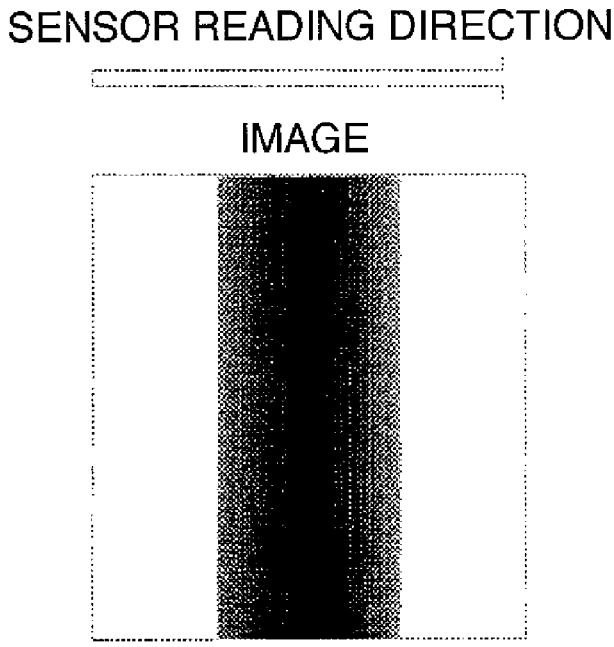
FIG. 8E
IMAGE DATA (VIDEO COUNT)
| | | | | | | |
|---|---|---|---|---|---|---|
| 0 | 0 | 95 | 100 | 95 | 0 | 0 |
| 0 | 0 | 95 | 100 | 95 | 0 | 0 |
| 0 | 0 | 95 | 100 | 95 | 0 | 0 |
| 0 | 0 | 95 | 100 | 95 | 0 | 0 |
| 0 | 0 | 95 | 100 | 95 | 0 | 0 |
| 0 | 0 | 95 | 100 | 95 | 0 | 0 |
| 0 | 0 | 95 | 100 | 95 | 0 | 0 |
FIG. 8F
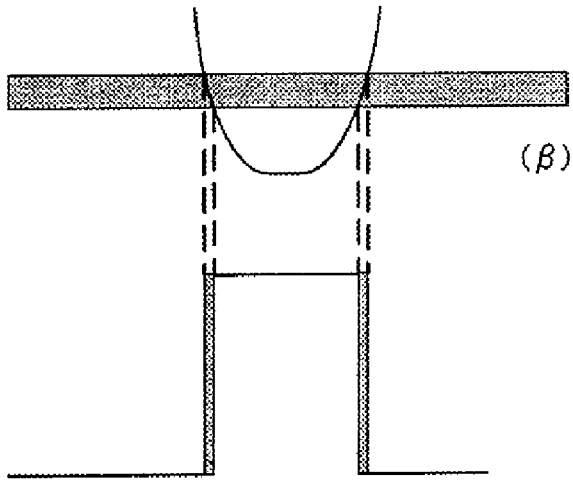

IMAGE FORMING APPARATUS AND IMAGE FORMING METHOD

BACKGROUND OF THE INVENTION

1. Field of the Invention

The present invention relates to an image forming apparatus and an image forming method which are of an electrophotographic type, an electrostatic recording type, or the like.

2. Description of the Related Art

There has conventionally been proposed a one drum type multicolor image forming apparatus capable of forming a color image. This image forming apparatus irradiates a drum-shaped electrophotographic photosensitive member as an image carrier, i.e., a photosensitive drum with laser beams or light from a light-emitting element such as an LED and forms electrostatic latent images on the photosensitive drum by an electrophotographic process. The electrostatic latent images are converted into visible images (toner images) for respective color components such as magenta (M), cyan (C), yellow (Y), and black (BK) using developing agents (toners) of the respective color components. In a transfer section, the toner images on the photosensitive drum are multiply transferred onto a transfer material conveyed by a drum-shaped transfer material conveying member (transfer drum) or the images are multiply transferred onto a belt-shaped intermediate transfer member (intermediate transfer belt) and then collectively transferred onto the transfer material.

There has also conventionally been proposed a color image forming apparatus having a plurality of photosensitive drums. This image forming apparatus includes a plurality of image forming sections, each of which performs a latent image forming step and a image development step on a corresponding photosensitive drum by an electrophotographic process. In a transfer section, toner images obtained in the image development step are multiply transferred onto a transfer material conveyed by a belt-shaped transfer material conveying member (transfer conveying belt) or the images are multiply transferred onto a belt-shaped intermediate transfer member (intermediate transfer belt) and then collectively transferred onto the transfer material.

An image forming apparatus of this type may suffer so-called "color misregistration" that is, a phenomenon in which images of respective colors are out of alignment when they are finally multiply transferred onto a transfer material. In particular, in a color image forming apparatus having a plurality of photosensitive drums, "color misregistration" may occur due to mechanical mounting errors among the photosensitive drums, errors in optical path length among laser beams, a change in optical path, or the like.

To cope with this, there is known an image forming apparatus which corrects color misregistration (see, e.g., Japanese Patent No. 02603254). In this image forming apparatus, optical sensors arranged adjacent to a photosensitive drum of an image forming section on the lowermost stream side read color misregistration correcting patterns formed on an intermediate transfer member (transfer and conveying belt) and detect color misregistration among images of respective colors formed on the transfer and conveying belt by image forming sections. The image forming apparatus performs electrical correction for image signals to be recorded on the basis of the detected color misregistration and, additionally or alternatively, drives turn-back mirrors provided in a laser beam optical path to automatically correct errors in optical path length or a change in optical path (a mode of performing automatic correction will hereinafter be referred to as an automatic adjustment mode).

The automatic adjustment mode is automatically activated, e.g., on the basis of the number of images formed or the number of hours the machine is used or at power-on to automatically correct process conditions for image formation.

Since a color misregistration correcting pattern is formed a plurality of times in the automatic adjustment mode to reduce errors caused by, e.g., eccentricity in a drive system, the automatic adjustment mode may last for several minutes. Also, the adjustments described above are performed between handling of one paper sheet (recording sheet) and that of another, and once the automatic adjustment mode is activated, image formation cannot be performed until the automatic adjustment mode exits. This reduces productivity.

To cope with this, there is known a technique for sensing color misregistration on the basis of an image formed on a recording sheet and correcting an image writing time and the like on the basis of the image (see, e.g., Japanese Laid-Open Patent Publication (Kokai) No. 9-314911).

However, the technique of Japanese Laid-Open Patent Publication (Kokai) No. 9-314911 suffers the following problems. First, an image with color misregistration is formed on a recording sheet until correction is performed. Secondly, if an appropriate image as shown in the embodiments of Japanese Patent No. 02603254 is not input, it is impossible to accurately perform color misregistration correction.

SUMMARY OF THE INVENTION

The present invention provides an image forming apparatus and an image forming method capable of carrying out color misregistration correction at an appropriate time and providing a high-quality image free from color misregistration.

In a first aspect of the present invention, there is provided an image forming apparatus comprising a toner image forming unit adapted to form a toner image on the basis of an input image information signal, an image width determination unit adapted to determine a width of the toner image on the basis of the input image information signal, before forming the toner image in a predetermined area, a formed image width detecting unit adapted to detect the width of the toner image formed in the predetermined area, a print width comparison unit adapted to compare the width determined by the image width determination unit with the width detected by the formed image width detecting unit, and a color misregistration judgment unit adapted to judge on the basis of a comparison result from the print width comparison unit whether or not color misregistration is present.

The color misregistration judgment unit can judge that the color misregistration is present if a difference between the width determined by the image width determination unit and the width detected by the formed image width detecting unit exceeds a predetermined value.

The image forming apparatus can further comprise an image width recording unit adapted to record the width determined by the image width determination unit.

The predetermined area can be located on an intermediate transfer member.

A time to correct the color misregistration can be determined on the basis of a comparison result from the print width comparison unit.

The predetermined area can be determined on the basis of an area which can be detected by the formed image width detecting unit.

The predetermined area can be an area where a toner image with a density not less a predetermined density and a width not less than a predetermined width is formed.

The image forming apparatus can further comprise an inhibition unit adapted to, if the toner image has a density not less than a predetermined density and has a portion with a density not less than the predetermined density and locations distant by a predetermined distance from edges which define the predetermined area, inhibit detecting of the edges as edges of a toner image formed in the predetermined area.

The predetermined area can comprise a plurality of predetermined areas.

The image forming apparatus can further comprise a color misregistration correction unit adapted to, if the color misregistration judgment unit judges that color misregistration is present, carry out color misregistration correction processing before transferring the toner image formed in the predetermined area onto a recording medium.

The toner image forming unit can form a toner image of a single color of black in the predetermined area and then superposes, on the toner image, at least one of toner images of respective colors other than black.

A width of the toner image to be superposed can be not more than a width of the toner image formed in the single color of black.

In a second aspect of the present invention, there is provided an image forming method comprising a toner image forming step of forming a toner image on the basis of an input image information signal, an image width determination step of determining a width of the toner image on the basis of the input image information signal, before formation of the toner image in a predetermined area, a formed image width detecting step of detecting the width of the toner image formed in the predetermined area, a print width comparison step of comparing the width determined in the image width determination step with the width detected in the formed width detecting step, and a color misregistration judgment step of judging on the basis of a comparison result from the print width comparison step whether or not color misregistration is present.

It is possible to carry out color misregistration correction at an appropriate time (a time before transferring toner images onto a transfer matter) and obtain a high-quality image free from color misregistration. It is also possible to avoid a reduction in productivity and undesired toner consumption caused by color misregistration correction after transfer of toner images onto a paper sheet as in a conventional case.

Further features and aspects of the present invention will become apparent from the following detailed description of exemplary embodiments with reference to the attached drawings.

BRIEF DESCRIPTION OF THE DRAWINGS

FIGS. 8A to 8F are charts each showing how edges of an image are.

DETAILED DESCRIPTION OF THE PREFERRED EMBODIMENTS

The following description of exemplary embodiments, features and aspects of the present invention is merely illustrative in nature and is in no way intended to limit the invention, its application, or uses.

Embodiments of the present invention will be described below with reference to the drawings.

First Embodiment

Figure 1:
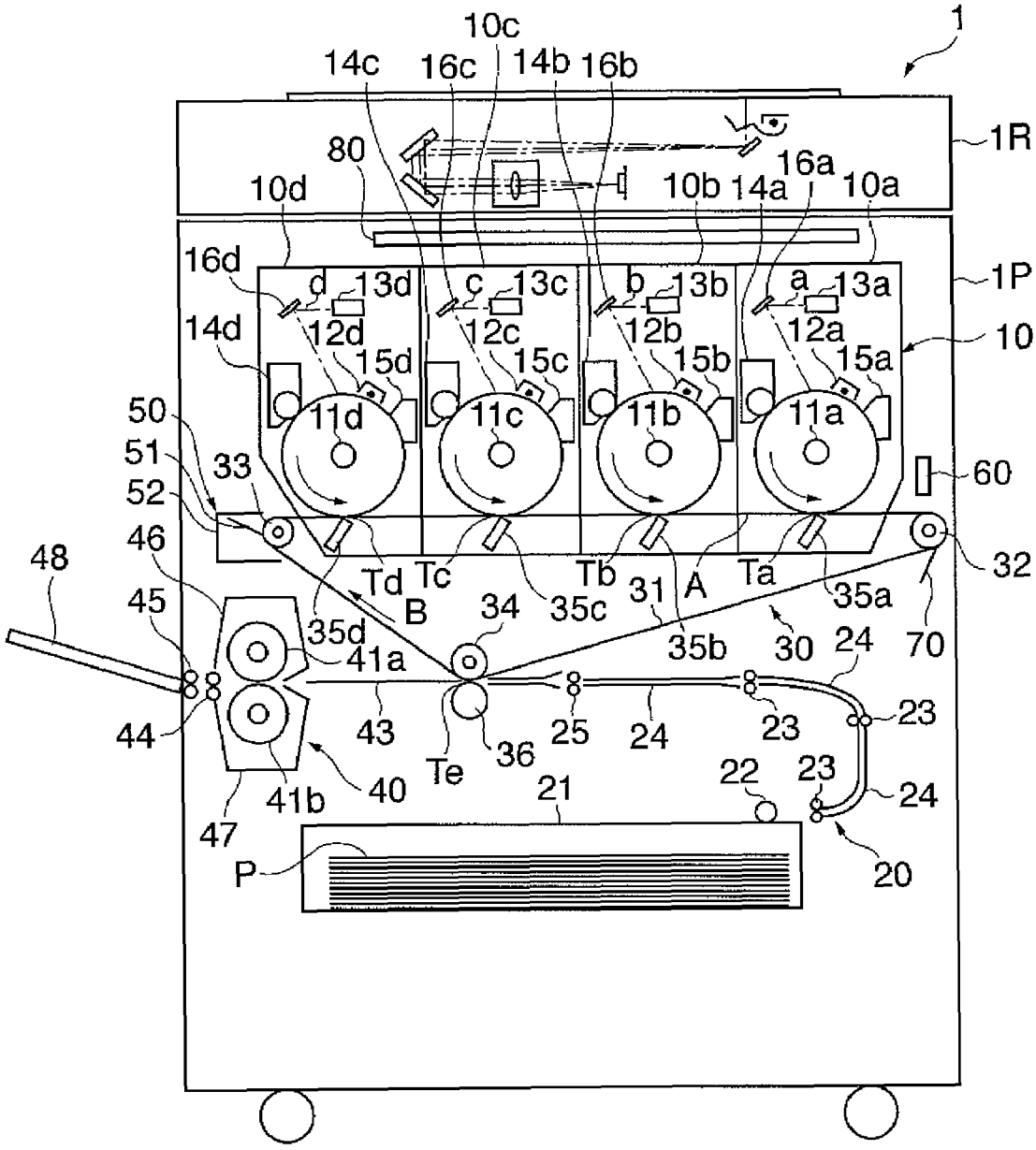
FIG. 1 is a schematic sectional view showing the overall configuration of an image forming apparatus according to a first embodiment of the present invention.

FIG. 1 is a schematic sectional view showing the overall configuration of an image forming apparatus according to a first embodiment of the present invention.

The image forming apparatus according to this embodiment is an electrophotographic color copying machine which has a plurality of image forming sections arranged in parallel and is of an intermediate transfer type.

In FIG. 1, an electrophotographic color copying machine 1 has an image reading section 1R and an image output section 1P. The image reading section 1R optically reads a document image, converts the document image into electrical signals, and sends the electrical signals to the image output section 1P. The image output section 1P has four image forming sections 10 (10*a*, 10*b*, 10*c*, and 10*d*) provided in parallel, a sheet feed unit 20, an intermediate transfer unit 30, a fixing unit 40, a cleaning unit 50, a cleaning blade 70, a photosensor 60, and a control unit 80.

The four image forming sections 10 (10*a* to 10*d*) provided in parallel have the same configuration. In the image forming sections 10 (10*a* to 10*d*), drum-shaped electrophotographic photosensitive members as first image carriers, i.e., photosensitive drums 11 (11*a* to 11*d*) are pivotally supported and rotatively driven in directions indicated by arrows. Primary electrostatic chargers 12 (12*a* to 12*d*), optical systems 13 (13*a* to 13*d*), turn-back mirrors 16 (16*a* to 16*d*), developing devices 14 (14*a* to 14*d*), and cleaning devices 15 (15*a* to 15*d*) are arranged in the rotational directions of the photosensitive drums 11*a* to 11*d* to oppose their outer circumferential surfaces.

The primary electrostatic chargers 12*a* to 12*d* charge the surfaces of the photosensitive drums 11*a* to 11*d* in a uniform amount. The optical systems 13*a* to 13*d* then expose the photosensitive drums 11*a* to 11*d* to light beams such as laser beams modulated on the basis of recording image signals from the image reading section 1R via the turn-back mirrors 16*a* to 16*d*, thereby forming electrostatic latent images on the photosensitive drums 11*a* to 11*d*.

The developing devices 14*a* to 14*d* storing developing agents (hereinafter referred to as "toners") of four colors of yellow, cyan, magenta, and black make the respective electrostatic latent images visible. In image transfer areas Ta, Tb, Tc, and Td, the visible images are transferred onto a belt-shaped intermediate transfer member as a second image carrier constituting the intermediate transfer unit 30, i.e., an intermediate transfer belt 31. The intermediate transfer unit 30 will be described in detail later.

On the downstream side of the image transfer areas Ta, Tb, Tc, and Td, the cleaning devices 15*a*, 15*b*, 15*c*, and 15*d* scrape off toner left on the photosensitive drums 11*a* to 11*d* without being transferred onto the intermediate transfer member, thereby cleaning the drum surfaces. With the above-described process, images are sequentially formed using toners of respective colors.

The sheet feed unit 20 has a cassette 21 storing transfer materials P, a manual feed tray (not shown), and a pickup roller 22 which feeds the transfer materials P one by one from the cassette 21 or the manual feed tray. The sheet feed unit 20 also has sheet feed roller pairs 23 which convey each transfer material P fed from the pickup roller 22 further, a sheet feed guide 24, and registration rollers 25 which feed the transfer material P to a secondary transfer area Te in synchronism with a time when the image forming sections 10 form images.

The intermediate transfer unit 30 will be described in detail.

The intermediate transfer belt 31 is tensely wound on a drive roller 32, a driven roller 33, and an secondary transfer counter roller 34. The drive roller 32 transmits drive force to the intermediate transfer belt 31. The driven roller 33 functions as a tension roller which applies a proper degree of tension to the intermediate transfer belt 31 by biasing force of a spring (not shown) and are rotated with rotation of the intermediate transfer belt 31. A primary transfer plane A is formed between the drive roller 32 and the driven roller 33 on the intermediate transfer belt 31. As the material for the intermediate transfer belt 31, for example, PET (polyethylene terephthalate), PVdF (polyvinylidene fluoride), or the like is used. The drive roller 32 is a metallic roller whose surface is coated with rubber (urethane or chloroprene) with a thickness of several mm to prevent a slip between the drive roller 32 and the belt. The drive roller 32 is rotatively driven by a pulse motor (not shown).

In the image transfer areas Ta to Td where the photosensitive drums 11*a* to 11*d* and the intermediate transfer belt 31 oppose each other, primary transfer electrostatic chargers 35 (35*a* to 35*d*) are arranged on the back side of the intermediate transfer belt 31. A secondary transfer roller 36 is arranged to oppose the secondary transfer counter roller 34. The secondary transfer counter roller 34 and the secondary transfer roller 36 form the secondary transfer area Te where they nip the intermediate transfer belt 31. The secondary transfer roller 36 is pressed against the intermediate transfer belt 31 with a proper pressure and can be separated from the intermediate transfer belt 31 by a pressure release device (not shown).

A cleaning unit 50 for cleaning an image forming surface of the intermediate transfer belt 31 is arranged downstream of the secondary transfer area Te of the intermediate transfer belt 31. The cleaning unit 50 includes a cleaning blade 51 for removing toner on the intermediate transfer belt 31 and a waste toner box 52 storing waste toner.

The cleaning blade 70 and the pulse motor (not shown) for attaching and detaching the cleaning blade 70 to and from the intermediate transfer belt 31 are provided around the drive roller 32 of the intermediate transfer belt 31. The cleaning blade 70 is also intended to remove toner on the intermediate transfer belt 31.

The fixing unit 40 has a fixing roller 41*a* which has a heat source such as a halogen heater incorporated therein and a fixing roller 41*b* (which may also include a heat source) which is pressed against the fixing roller 41*a*. The fixing unit 40 also includes a conveying guide 43 for guiding a transfer material P to a nip section which is located between the pair of fixing rollers 41*a* and 41*b* and fixing heat insulating covers 46 and 47 for trapping heat generated by the fixing unit 40 inside. The fixing unit 40 further includes inner sheet discharge rollers 44 and outer sheet discharge rollers 45, both of which guide the transfer material P fed from the pair of fixing rollers 41*a* and 41*b* to outside the apparatus, a sheet discharge tray 48 on which transfer materials P are stacked, and the like.

The operation of the electrophotographic color copying machine with the above-described configuration will be described.

A control unit 80 has a CPU (not shown) for controlling the operations of the mechanisms in the above-described units, a registration correction circuit (not shown), a motor driver section (not shown), and the like. When an image forming operation start signal is issued from the CPU, the operation starts of feeding sheets from a sheet feed stage selected on the basis of a selected paper sheet size and the like.

For example, a case where a paper sheet is fed from a sheet feed stage to the secondary transfer area Te. In FIG. 1, transfer materials P are fed one by one from the cassette 21 by the pickup roller 22. Each transfer material P is guided through the sheet feed guide 24 by the sheet feed roller pair 23 to convey to the registration rollers 25. At this time, the registration rollers 25 are at rest, and the leading edge of the transfer material P abuts against the nip section. After that, the registration rollers 25 start rotating in synchronism with a time when the image forming sections 10 start image formation. The time for rotation is set such that the transfer material P and toner images primarily transferred onto the intermediate transfer belt 31 from the image forming sections 10 join together in the secondary transfer area Te.

In the image forming sections 10, when the image forming operation start signal is issued from the control unit 80, a toner image formed on the photosensitive drum 11*d* is primarily transferred onto the intermediate transfer belt 31 in the image transfer area Td by the primary transfer electrostatic charger 35*d*, to which a high voltage is applied. The primarily transferred toner image is conveyed to the next primary transfer area Tc. In the primary transfer area Tc, image formation has been performed after a time lag corresponding to the time required for conveyance of the toner image between the adjacent image forming sections. The next toner image is transferred onto the previously toner image in such a manner that they are in registration. The same process is repeatedly carried out in the primary transfer areas Tb and Ta. As a result, toner images of the four colors are primarily transferred onto the intermediate transfer belt 31.

After that, when the transfer material P enters the secondary transfer area Te to come into contact with the intermediate transfer belt 31, a high voltage is applied to the secondary transfer roller 36 in synchronism with a time when the transfer material P passes through the secondary transfer area Te. This causes the toner images of the four colors formed on the intermediate transfer belt 31 by the above-described process to be transferred onto the surface of the transfer material P.

The transfer material P is then accurately guided to the nip section which is located between the pair of the fixing rollers 41*a* and 41*b* by the conveying guide 43. The toner images are fixed on the surface of the transfer material P by heat and nip pressure from the pair of fixing rollers 41*a* and 41*b*. After that, the transfer material P is conveyed by the inner and outer sheet discharge rollers 44 and 45, discharged to outside the apparatus, and stacked on the sheet discharge tray 48.

FIGS. 2A to 2F are views showing the configuration of the photosensor 60 in FIG. 1 and the arrangement of the photosensor 60 with respect to the intermediate transfer belt 31 and their variations. More specifically, FIG. 2A to 2C each shows a case where no toner is present on the intermediate transfer belt 31 while FIGS. 2D to 2F each shows a case where toner is present on the intermediate transfer belt 31.

Figure 2A:
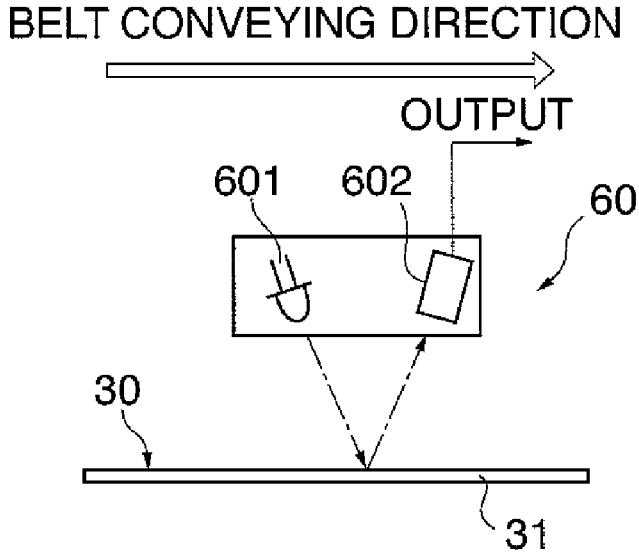
FIGS. 2A to 2F are views showing the configuration of a photosensor in FIG. 1 and the arrangement of the photosensor with respect to an intermediate transfer belt and their variations.
Figure 2B:
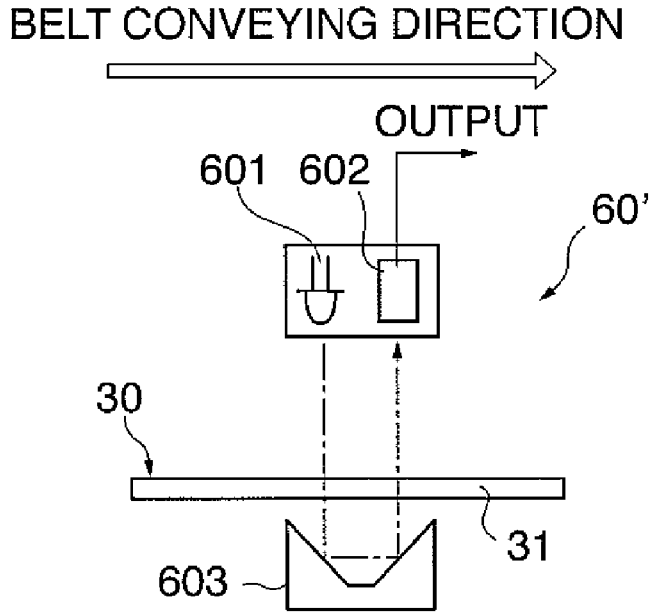
Figure 2C:
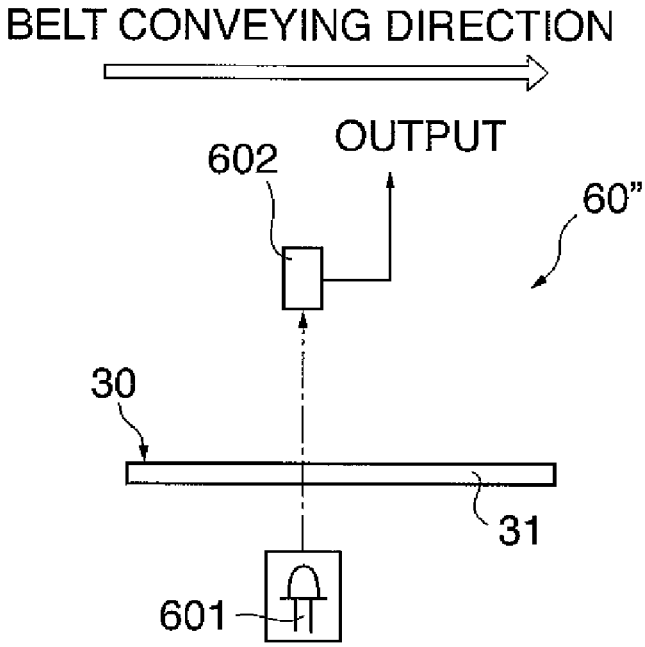

The photosensor 60 includes a light-emitting element 601 and a light-receiving element 602. If the intermediate transfer belt 31 reflects light from the light-emitting element 601, the light-emitting element 601 and light-receiving element 602 are arranged in a manner as shown in FIG. 2A. If toner is present (FIG. 2D), the amount of light which comes incident on the light-receiving element 602 decreases. If the intermediate transfer belt 31 transmits light, it is possible to detect the presence or absence of toner using a prism 603, as shown in FIGS. 2B and 2E. In the case where the intermediate transfer belt 31 transmits light, it is also possible to detect the presence or absence of toner, as shown in FIGS. 2C and 2F by arranging the light-emitting element 601 and light-receiving element 602 such that the intermediate transfer belt 31 is sandwiched between them.

Figure 2D:
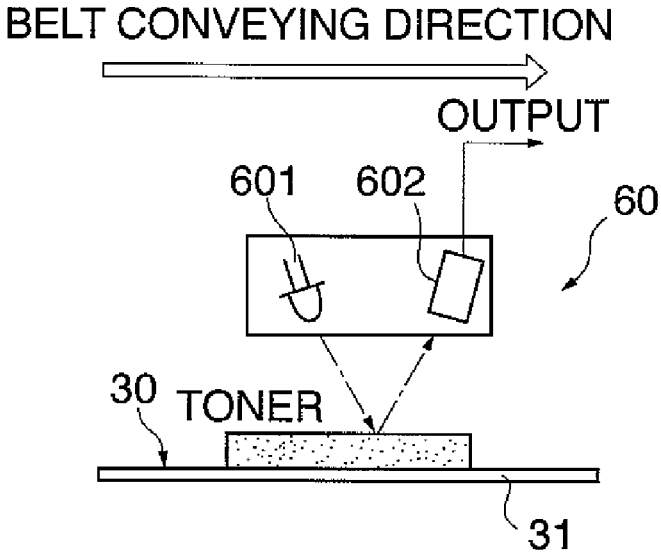
Figure 2E:
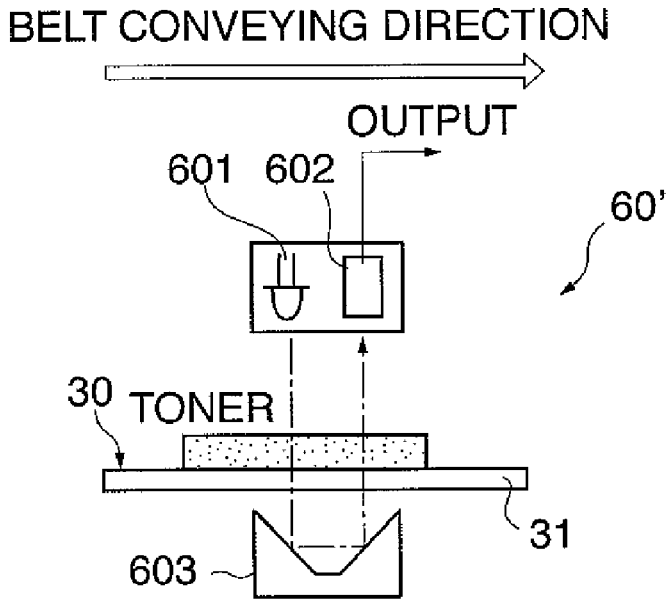
Figure 2F:
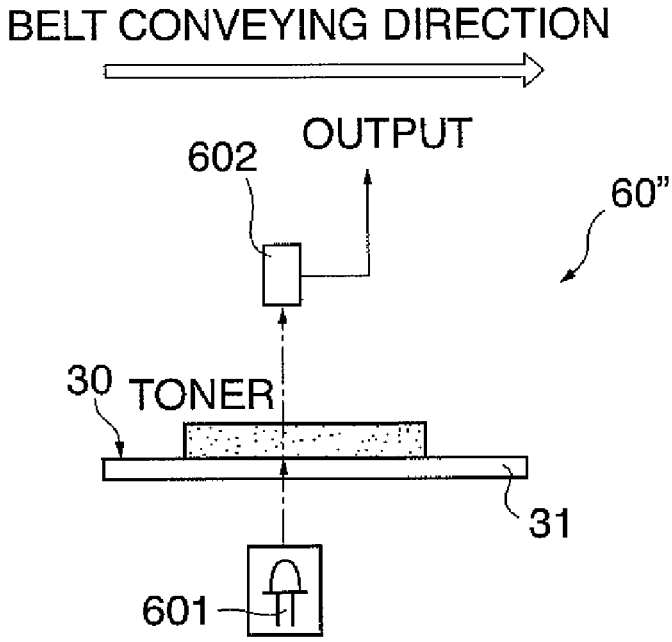
Figure 3A:
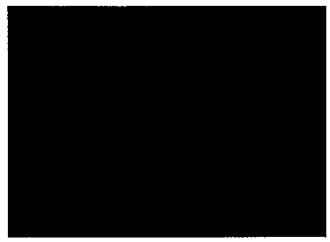
FIGS. 3A to 3C are charts used to explain an output from a light-receiving element in FIG. 2A, with FIG. 3A showing an example of a toner image, FIG. 3B showing an example of an output value from the light-receiving element, and FIG. 3C showing an output waveform obtained when the output value in FIG. 3B is sliced at a predetermined level (β).

FIGS. 2A and 2D will be described in more detail. Since the intermediate transfer member 31 has a high reflectivity, if no toner is present on the intermediate transfer member, a large amount of light from the light-emitting element 601 comes incident on the light-receiving element 602, as shown in FIG. 2A. On the other hand, if toner is present on the intermediate transfer member (FIG. 2D), the reflectivity decreases, and the amount of light which comes incident on the light-receiving element 602 decreases. That is, if a toner image as shown in FIG. 3A is present, an output as shown in FIG. 3B can be obtained from the light-receiving element 602.

Figure 3B:
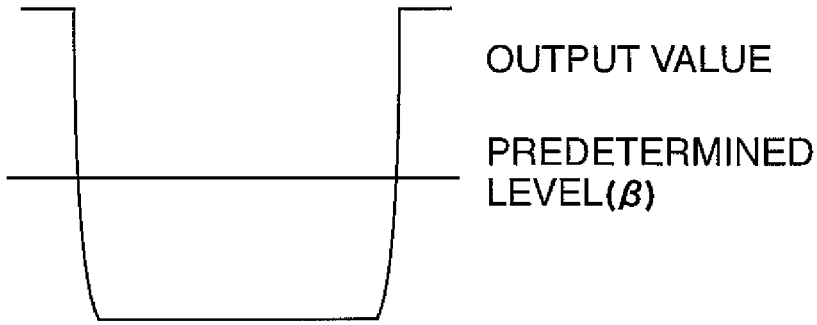
Figure 3C:
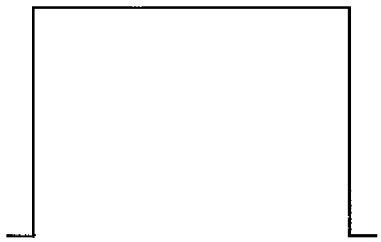

It is possible to identify an area bearing toner on the intermediate transfer belt 31 by slicing the output value shown in FIG. 3B at a predetermined level (β) in a circuit incorporated in the control unit 80 or photosensor 60 to output a value as shown in FIG. 3C. Instead of the above sensor, a line sensor, area sensor, or the like may be used in this embodiment as long as it is capable of detecting the presence or absence of toner.

Figure 4:
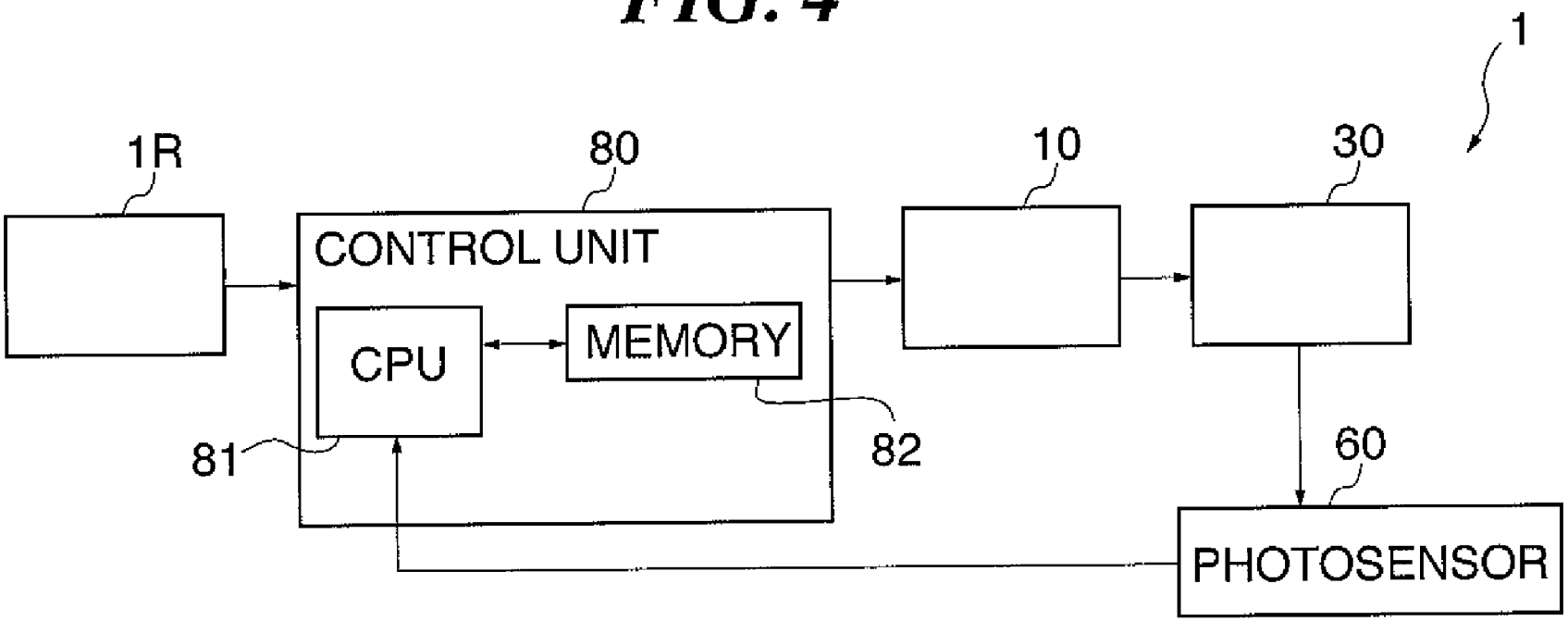
FIG. 4 is a block diagram showing the schematic configuration of the image forming apparatus.

A registration error detecting method which is a characteristic of this embodiment will be described using a block diagram showing the schematic configuration of the image forming apparatus 1 shown in FIG. 4.

Figure 5:
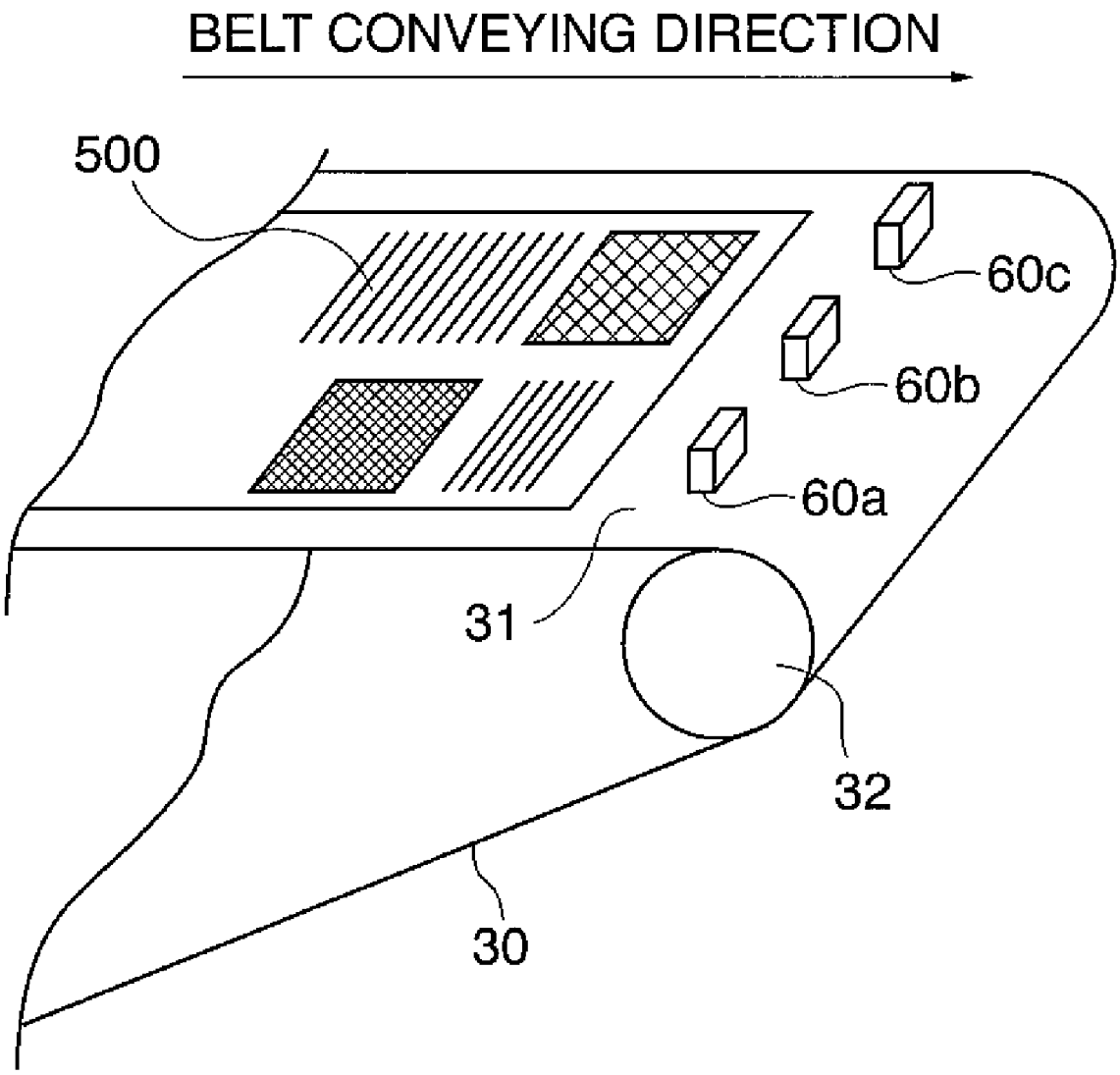
FIG. 5 is a view showing the arrangement of photosensors.

First, recording image signals from the image reading section 1R, a PC (not shown), or the like are input to the control unit 80. In the control unit 80, the input recording image signals are subjected to image processing including shading correction, gamma correction, and color space processing. A CPU 81 determines at least one image detected part detected by the photosensor 60 in an image detected part determination process (to be described later) on the basis of the recording image signals having undergone the image processing and the mounting location of the photosensor 60. The CPU 81 (an image width determination unit) computes (determines) the width in the sub-scanning direction of an image to be formed in an image detected part (predetermined area) on the basis of the recording image signals (image information signals), before the formation of the image at the image detected part, and records the width in a memory 82. In parallel with this, the image forming sections 10 (toner image forming units) form images (toner images) on the basis of the recording image signals, and the images of respective colors are superposed in the intermediate transfer unit 30. As shown in FIG. 5, the photosensor 60 (60*a*, 60*b*, and 60*c*) (a formed image width detecting unit) serving as an image reading unit is located between the drive roller 32 and the photosensitive drum 11*a* (FIG. 1) located at the lowermost stream in the belt traveling direction of the photosensitive drums 11*a* to 11*d* and reads a toner image 500 formed on the intermediate transfer belt 31 (a toner image formed in a predetermined area).

A time when the photosensor 60 reads an image is determined on the basis of an image writing signal (I-top signal), a delay time periods for the respective image forming sections 10 from the time point when receiving the image writing signal to the time point when arriving at each image detected part, and the distance between the image forming sections 10 and the photosensor 60. A signal read by the photosensor 60 is input to the control unit 80. The control unit 80 (a print width comparison unit and a color misregistration judgment unit) compares the width in the sub-scanning direction of an image earlier stored in the memory 82 (a width determined by the image width determination unit) with the signal from the photosensor 60, i.e., the width of an actually read toner image (a width detected by the formed image width detecting unit). If the comparison result shows that the difference between the widths exceeds a predetermined value, it is judged that color misregistration is present. At this time, it is possible to increase the precision of the judgment using a plurality of image detected parts.

An image detected part determination process will be described with reference to FIG. 6. The process is executed by the CPU 81 in the control unit 80.

In step S401, only a portion that the photosensor 60 (60*a*, 60*b*, and 60*c*) can detect is extracted from image writing signals input to the control unit 80. In step S402, it is judged whether or not the extracted portion contains an area of a plurality of colors which has a density not less than a predetermined density and a sub-scanning width not less than a predetermined width.

If there is no area which meets the condition in step S402, setting of an image detected part for detecting color misregistration is inhibited (step S403), and the process is terminated.

If there is an area which meets the condition in step S402, it is judged in step S404 whether or not edges of the area are sharp.

If it is judged in step S404 that the edges of the area are not sharp, setting of an image detected part for detecting color misregistration is inhibited in step S403, and the process is terminated.

On the other hand, if it is judged in step S404 that the edges of the area are sharp, it is judged in step S405 whether or not there is a portion with a density not more than the predetermined density at each end of the area which extends from the corresponding edges in the sub-scanning direction and has a width not less than a predetermined width.

If the condition in step S405 is not met, setting of an image detected part for detecting color misregistration is inhibited in step S405, and the process is terminated.

On the other hand, if the condition in step S405 is met, the portion is set as an image detected part in step S406, and the process is terminated.

Figure 7A:
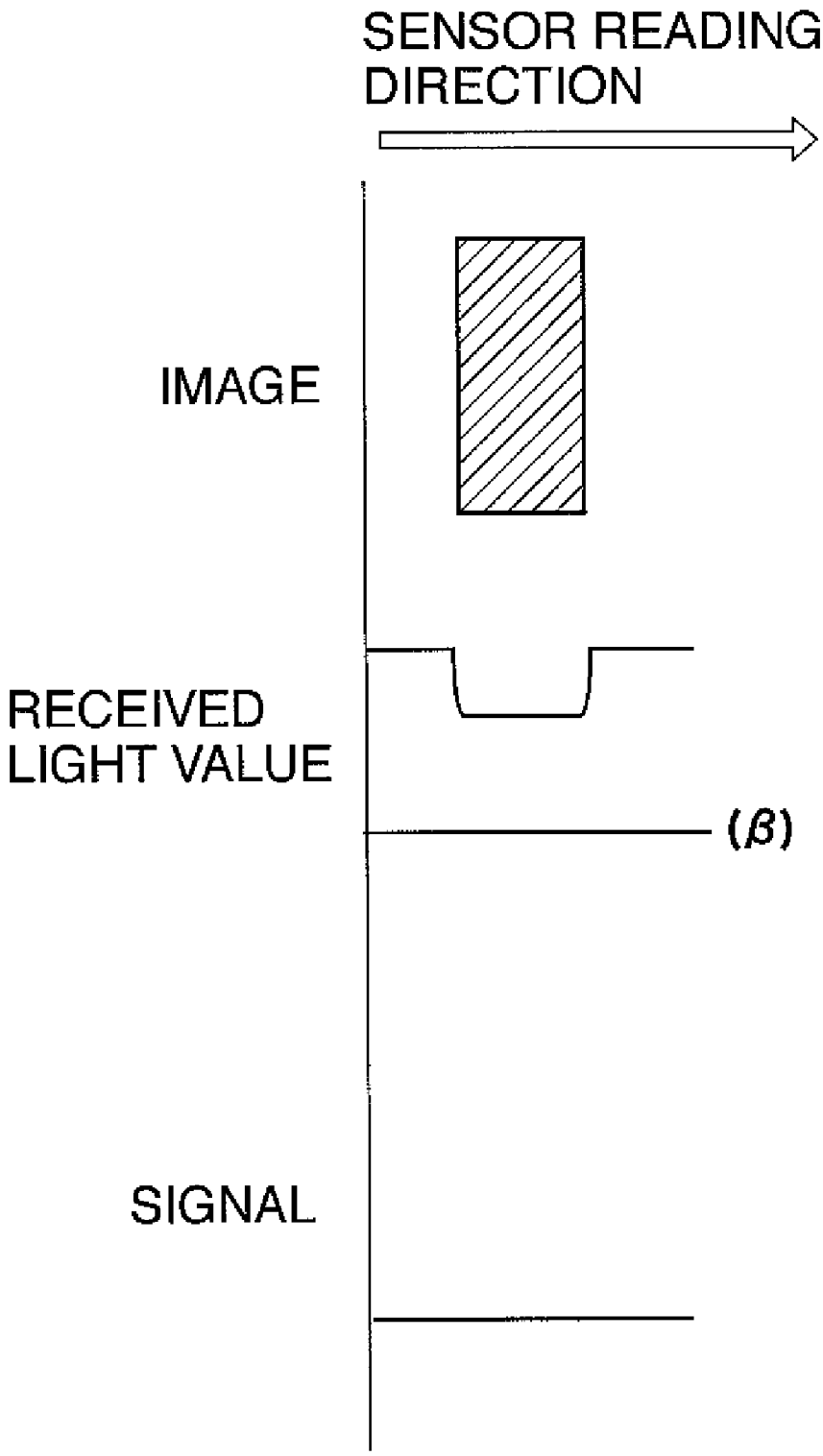
FIGS. 7A to 7C are charts each showing the state of an output value from the photosensor with respect to the density and width of an image.
Figure 7B:
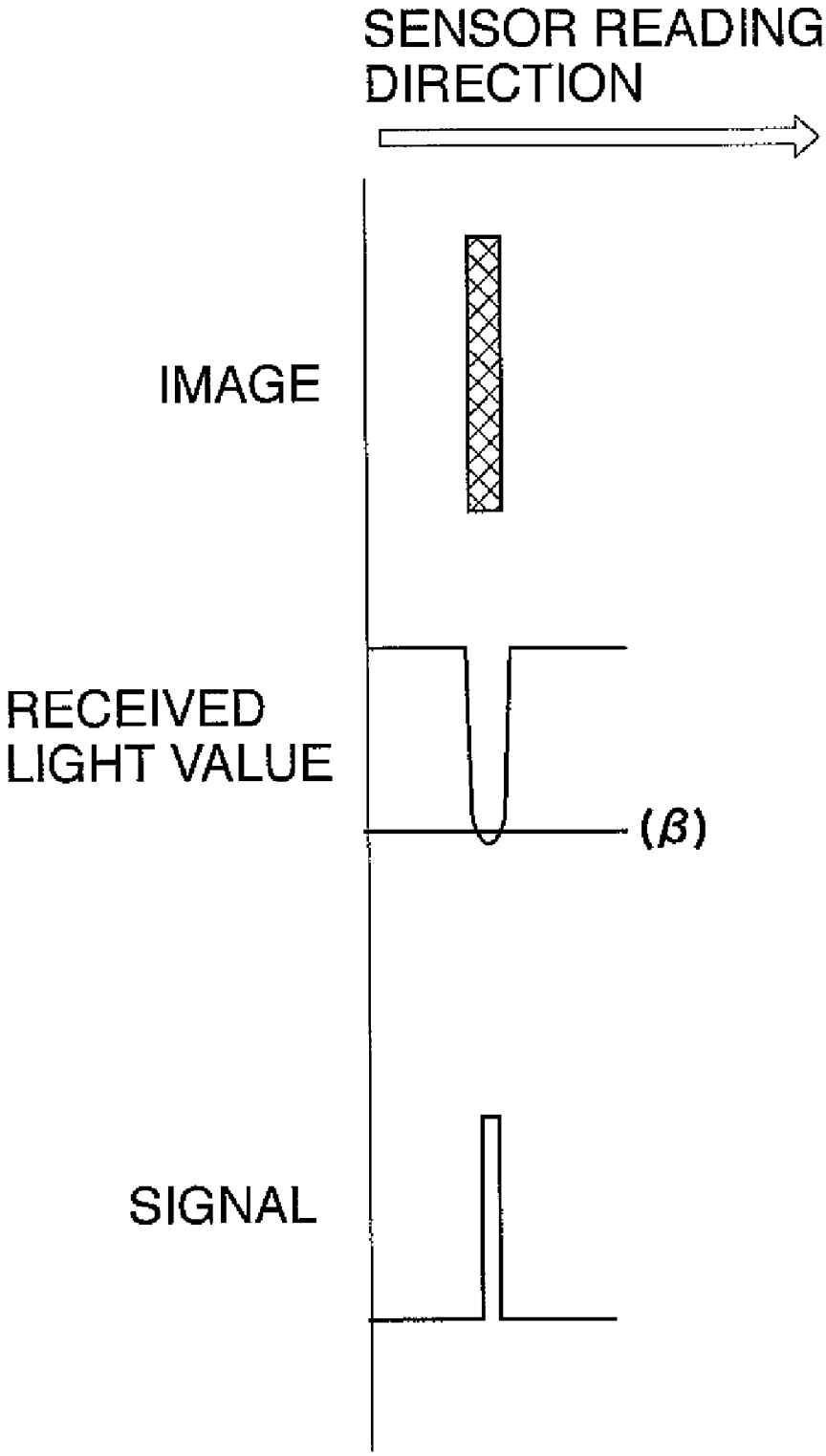
Figure 7C:
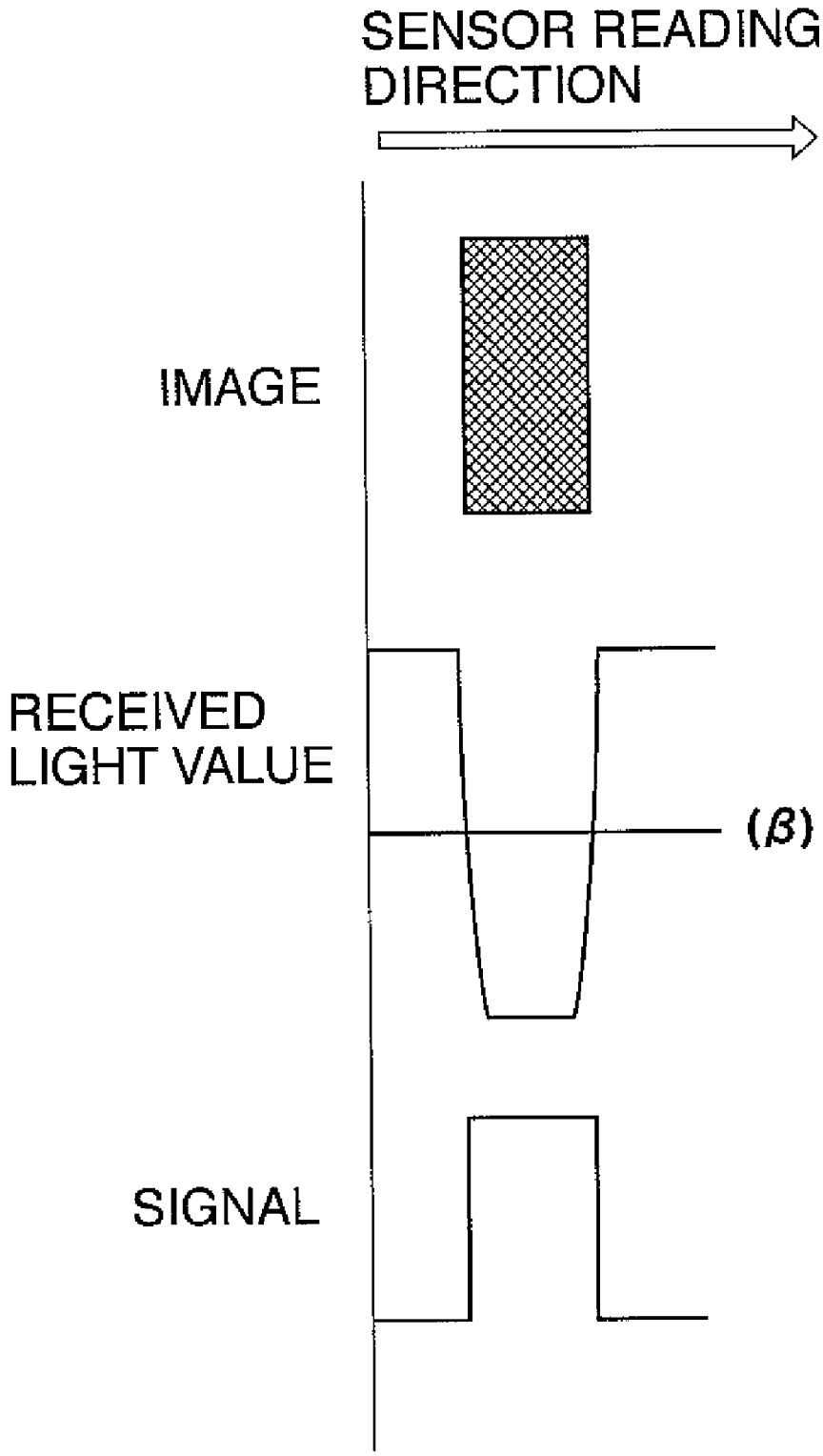

FIGS. 7A to 7C are charts each showing the state of an output value from the photosensor 60 with respect to the density and width of an image. Since an image in FIG. 7A does not have a sufficiently high density, the S/N ratio becomes low, and it is difficult to accurately recognize the image. The image thus does not meet the condition in step S402. Since an image in FIG. 7B does not have a sufficiently large sub-scanning width, the photosensor 60 cannot sufficiently react to the image, and it is difficult to accurately recognize the image. The image thus does not meet the condition in step S402. Since an image in FIG. 7C has a sufficiently high density and a sufficiently large width, it is possible to accurately recognize the image. The image thus meets the condition in step S402.

FIGS. 8A to 8F are charts each showing how edges of an image are.

In FIG. 8A, at each edge, the density of an image gradually changes, and the amount of light which comes incident on the light-receiving element 602 gradually changes. Accordingly, even a slight deviation of a threshold level (β) causes a large error. For this reason, it is difficult to accurately determine the edges of the image, and the image in FIG. 8A does not meet the condition in step S404. In FIG. 8D, at each edge, the density of an image rapidly changes, and the amount of light which comes incident on the light-receiving element 602 rapidly changes. For this reason, it is possible to accurately determine the edges regardless of a change in threshold level (β), and thus the image in FIG. 8D meets the condition in step S404.

Figure 9A:
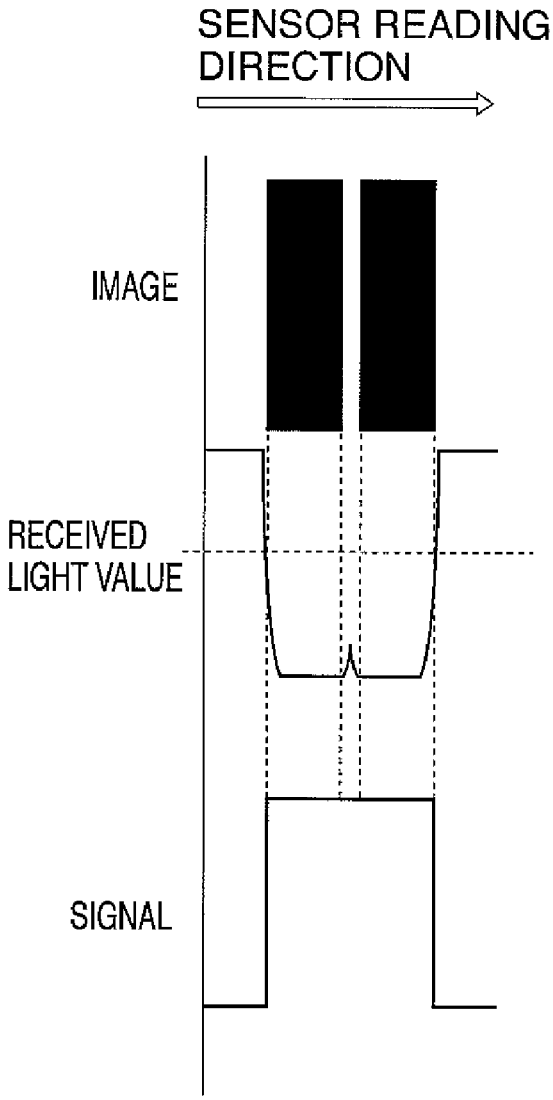
FIGS. 9A and 9B are charts each showing the state of an output value from the photosensor with respect to an interval between images.
Figure 9B:
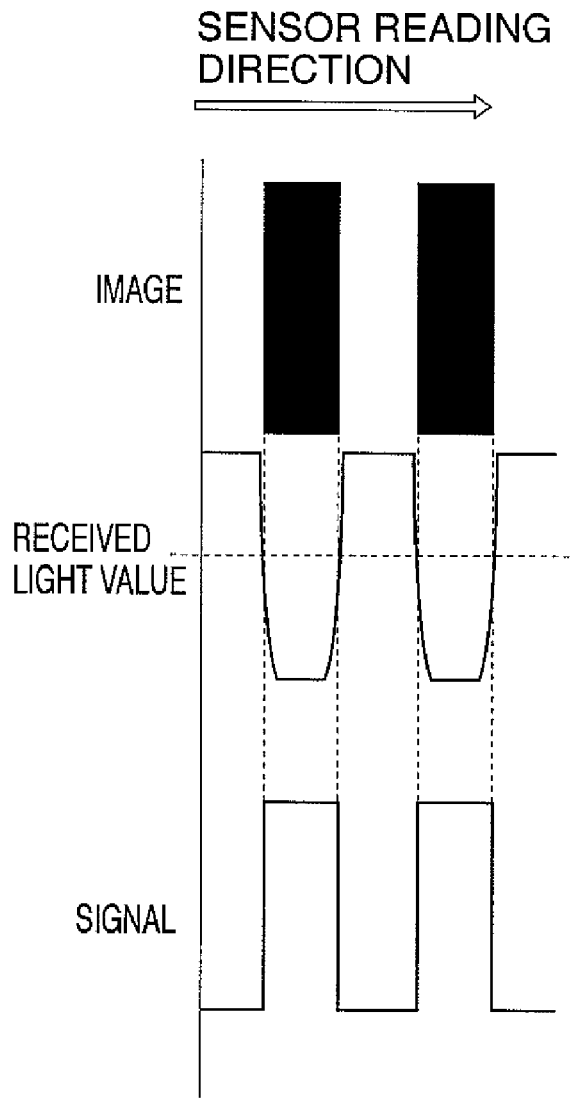

FIGS. 9A and 9B are charts each showing the state of an output value from the photosensor 60 with respect to an interval between images.

In FIG. 9A, since the portion with a density not more than the predetermined density does not have a sufficiently large width, the sensor mistakenly detects that two images to be detected are connected. Thus the images cannot be accurately recognized. That is, the image in FIG. 9A does not meet the condition in step S405 of FIG. 6. In FIG. 9B, the portion with a density not more than the predetermined density has a sufficiently large width. Thus the images can be accurately recognized. That is the image in FIG. 9B meets the condition in step S405 of FIG. 6.

Figure 10:
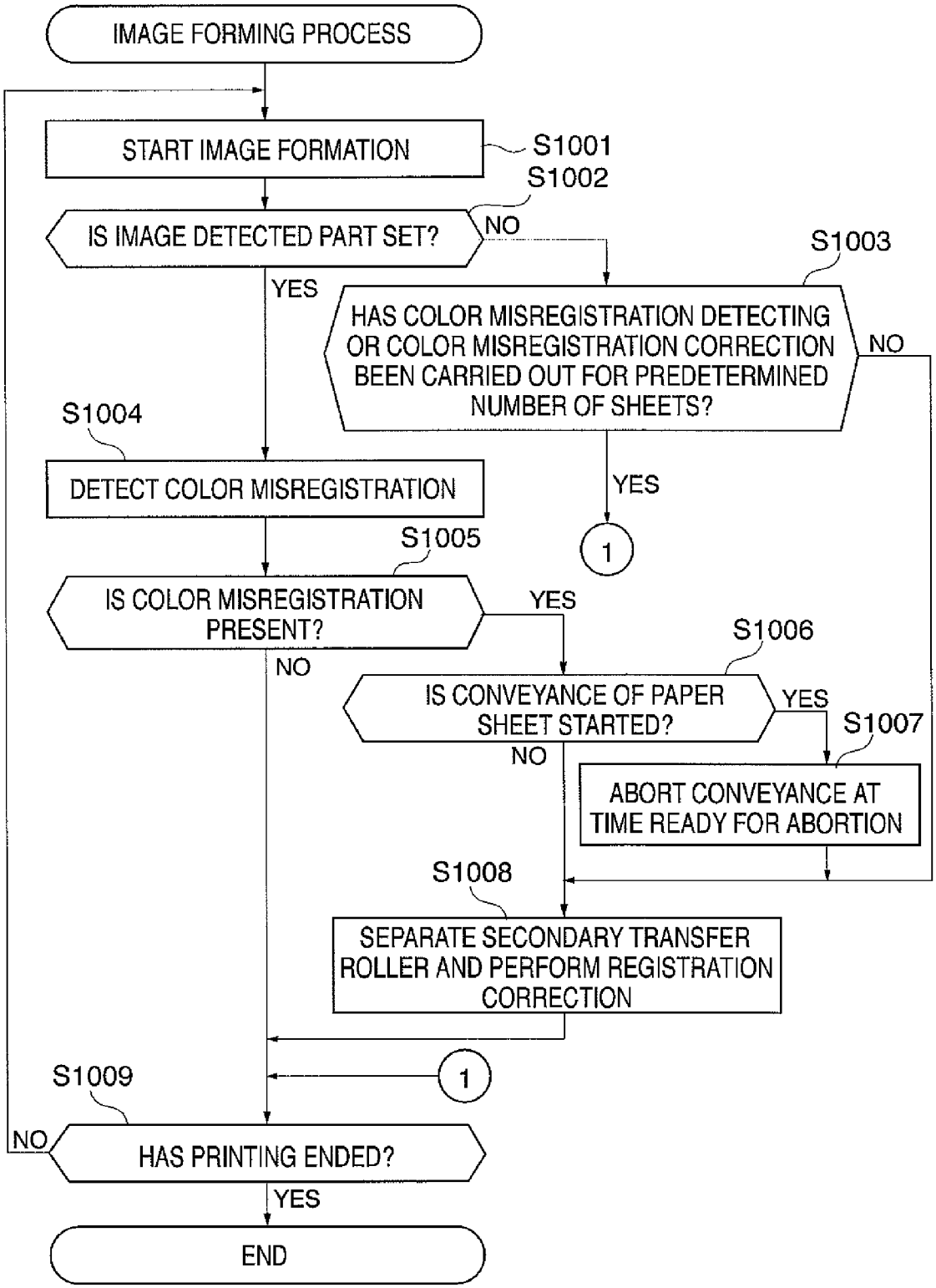
FIG. 10 is a flow chart showing the image forming procedure processes carried out by the CPU.

FIG. 10 is a flow chart showing the image forming procedure carried out by the CPU 81.

First, image formation is started (step S1001). At this time, setting of an image detected part is performed on the basis of the image detected part determination process described above.

It is then judged whether or not an image detected part is set (step S1002).

If no image detected part is set in step S1002, it is judged whether color misregistration detecting or color misregistration correction has been carried out for a predetermined number of sheets (step S1003).

If color misregistration detecting or color misregistration correction has been carried out for the predetermined number of sheets in step S1003, the process proceeds to step S1009. On the other hand, if color misregistration detecting or color misregistration correction has not been carried out for the predetermined number of sheets, the process proceeds to step S1008.

If an image detected part is set in step S1002, color misregistration detecting is performed using the registration error detecting method (FIG. 4) (step S1004).

It is judged whether or not the detected result obtained in step S1004 shows that color misregistration is present (step S1005).

If it is judged in step S1005 that color misregistration is present, it is judged whether or not a paper sheet (transfer material P) onto which an image with detected color misregistration is to be transferred has started to be conveyed from the registration rollers 25 (step S1006).

If the paper sheet has not started to be conveyed from the registration rollers 25 in step S1006, image formation is immediately stopped, the secondary transfer roller 36 is separated from the intermediate transfer belt 31 by a separation motor (not shown), and color misregistration correction (registration correction) processing is started (step S1008). During this processing, the paper sheet is on standby between the registration rollers 25. Upon completion of the color misregistration correction processing, image formation is resumed, and an image is transferred onto the paper sheet on standby between the registration rollers 25 and is fixed.

On the other hand, if the paper sheet has started to be conveyed from the registration rollers 25 in step S1006, image transfer and fixation are performed only for the transfer material P, and image formation is aborted at a time ready for abortion (step S1007). After that, the process proceeds to step S1008.

When the color misregistration correction processing is terminated in step S1008 or if it is judged in step S1005 that no color misregistration is present, it is judged whether or not the whole of the printing has ended (step S1009). The process returns to step S1001 to repeat the above-described process until the printing ends in step S1009.

In this embodiment, if the paper sheet has not started to be conveyed from the registration rollers 25 in step S1006, the secondary transfer roller 36 is separated. However, if it is possible to detect color misregistration early enough, the cleaning blade 70 may be made to abut against the intermediate transfer belt 31 by the motor (not shown) to clean toner off the belt 31.

In this embodiment, color misregistration detecting is performed on the intermediate transfer belt 31 (intermediate transfer member). However, the present invention is not limited to this embodiment. Color misregistration detecting may be performed at a location where toner images of a plurality of colors are superposed (e.g., on an intermediate transfer drum) before the images are transferred onto a transfer material P.

As has been described above in detail, according to this embodiment, the control unit 80 determines the width of a toner image on the basis of recording image signals before the formation of the toner image at an image detected part and detects the width of the toner image formed at the image detected part on the basis of an output from the photosensor 60. After that, the control unit 80 compares the determined width with the detected width and judges on the basis of the comparison result whether or not color misregistration is present. As described above, since color misregistration is detected using an output from the photosensor 60 and recording image signals before toner images are transferred onto a transfer material P, it is possible to carry out color misregistration correction at an appropriate time (a time before the toner images are transferred onto the transfer material P) and obtain a high-quality image free from color misregistration. It is also possible to avoid a reduction in productivity and consumption of toner required only for color misregistration correction caused by color misregistration correction after transfer of toner images onto a paper sheet as in a conventional case.

Second Embodiment

In the first embodiment, the image detected part determination process is carried out using a portion where toner images of a plurality of colors overlap. In this embodiment, an image detected part determination process is carried out by superposing at least one of images of respective colors on a portion of a single color of BK (black). Accordingly, components of an image forming apparatus according to this embodiment are basically the same as those of the first embodiment. The same components are denoted by the same reference numerals, and a redundant description will be omitted.

An image detected part determination process according to this embodiment will be described below in detail.

Figure 6:
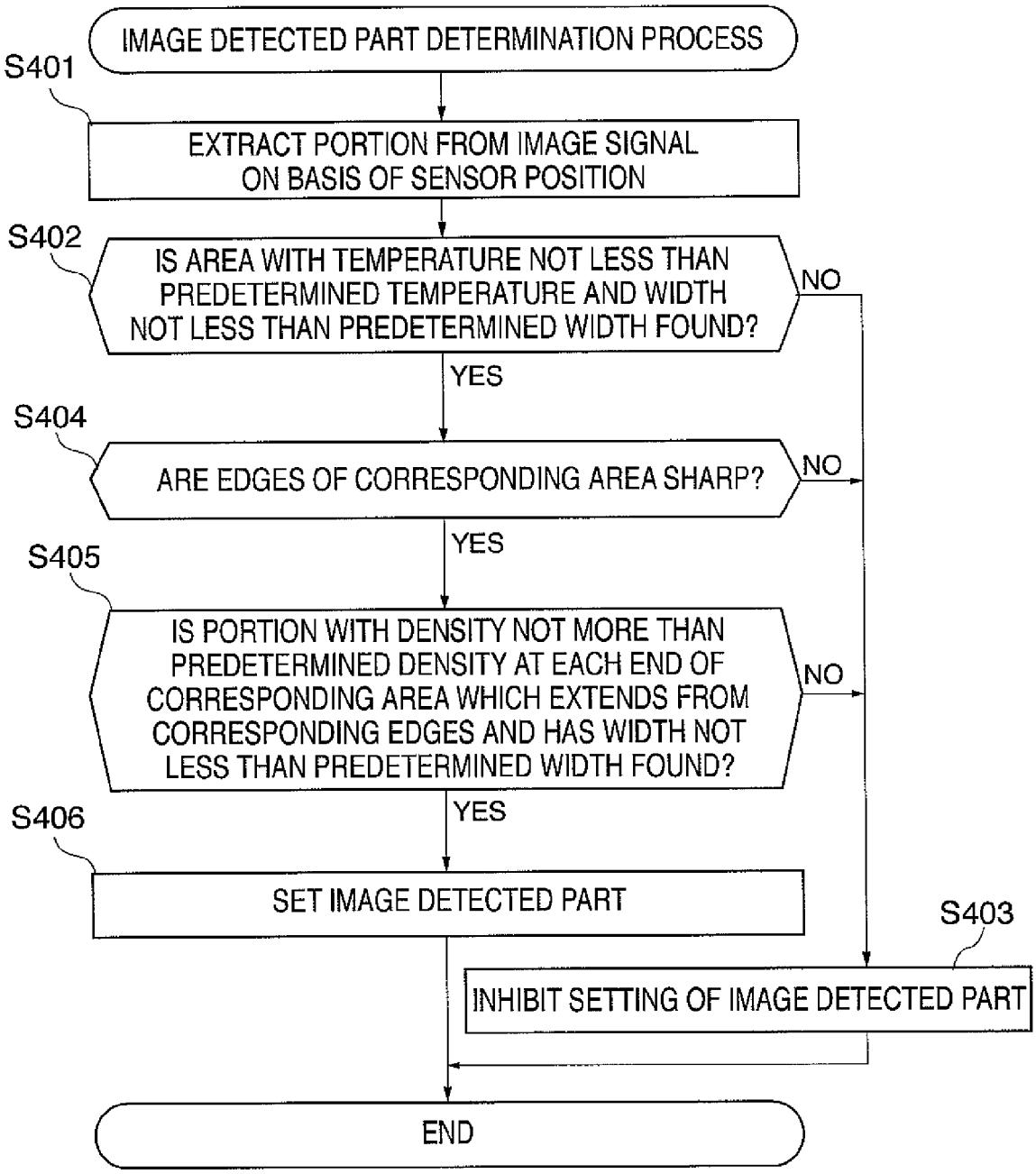
FIG. 6 is a flow chart showing the procedure for an image detected part determination process carried out by a CPU in FIG. 4.
Figure 11A:
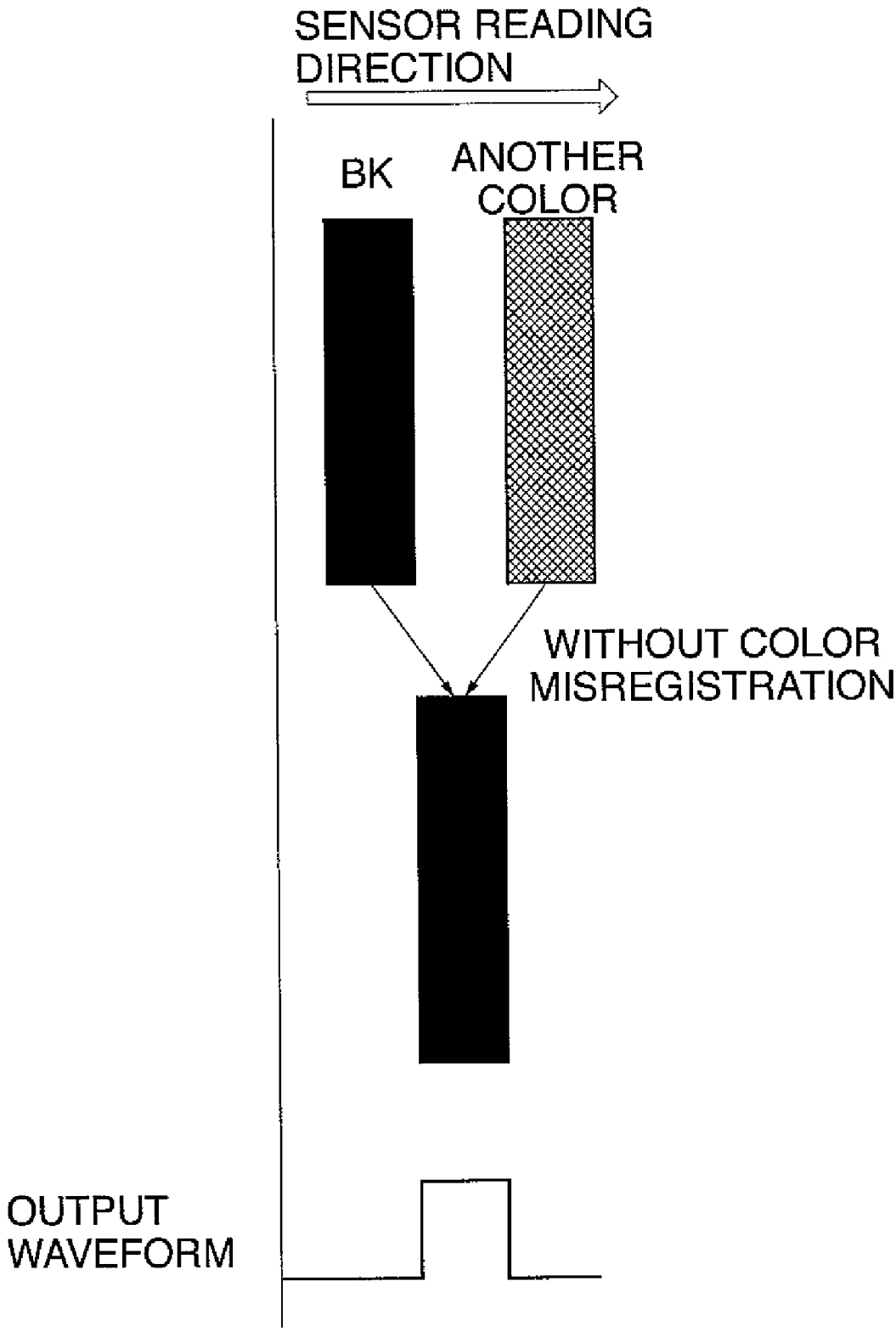
FIGS. 11A and 11B are charts used to explain an image detected part determination process in an image forming apparatus according to a second embodiment of the present invention.
Figure 11B:
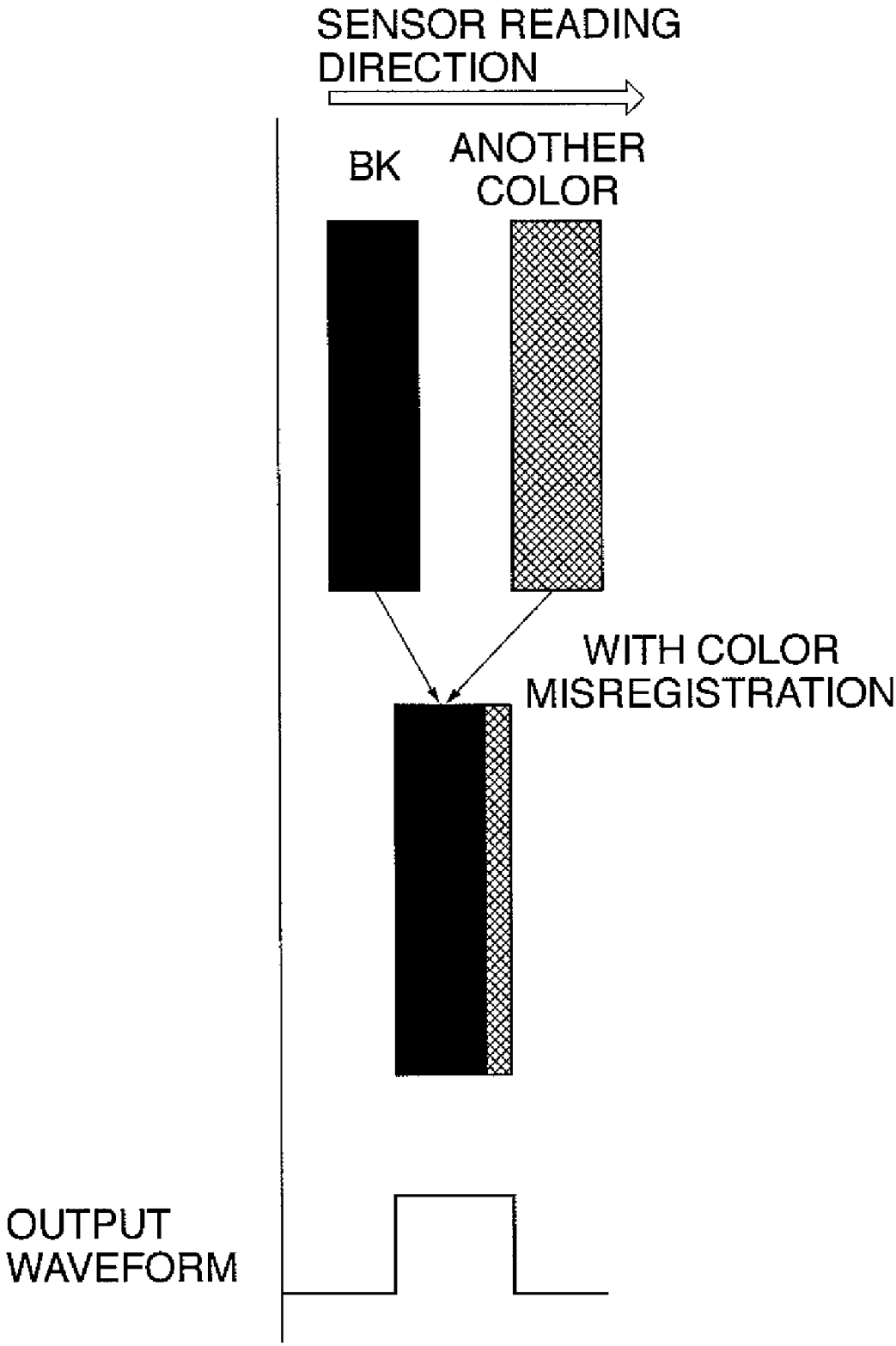

At the time of determining an image detected part, the image detected part determination process in FIG. 6 is carried out at a location where an image of the single color of BK is printed. After an image detected part is set in step S406 of FIG. 6, at least one of images of respective colors other than BK (e.g., yellow, magenta, or cyan) is superposed at the image detected part, as shown in FIGS. 11A and 11B.

If no color misregistration is present (see FIG. 11A), only reflected light with a width corresponding to the image of the single color of BK is detected by the photosensor 60, and the image of the other color superposed after fixation is masked by BK and becomes invisible. If color misregistration is present (see FIG. 11B), when the photosensor 60 receives reflected light, color misregistration is detected by the registration error detecting method described above. Since color misregistration correction processing is started before the images are transferred onto a transfer sheet P, the processing does not cause the print quality to be degraded.

By making the image of the other color to be superposed smaller than the image of BK at the time of superposing the image of the other color on the image of the single color of BK, it is possible to prevent the image of the other color from protruding from the image of BK if misregistration corresponding to a reading error occurs. By setting a location where the image of the other color is superposed at, e.g., a predetermined distance from the periphery of the transfer sheet P, even if the image of the other color protrudes, and it is impossible to detect the color misregistration, user discomfort is suppressed compared to a case where color misregistration is present in the center of the transfer sheet P.

As has been described above, since at least one of images of respective colors other than BK is superposed on a portion of the single color of BK, and color misregistration is detected before toner images are transferred onto a transfer material P using an output obtained from detecting by the photosensor 60 and recording image signals, it is possible to carry out color misregistration correction at an appropriate time (a time before the toner images are transferred onto the transfer material P) and obtain a high-quality image free from color misregistration. It is also possible to avoid a reduction in productivity and consumption of toner required only for color misregistration correction caused by color misregistration correction after transfer of toner images onto a paper sheet as in a conventional case.

Third Embodiment

In the first embodiment, the electrophotographic color copying machine 1 having the plurality of image forming sections 10 is used. However, a one drum type color image forming apparatus having one image forming section is also capable of carrying out the processes described in the first and second embodiments.

A one drum type color image forming apparatus as an image forming apparatus according to a third embodiment of the present invention will be described below.

Figure 12:
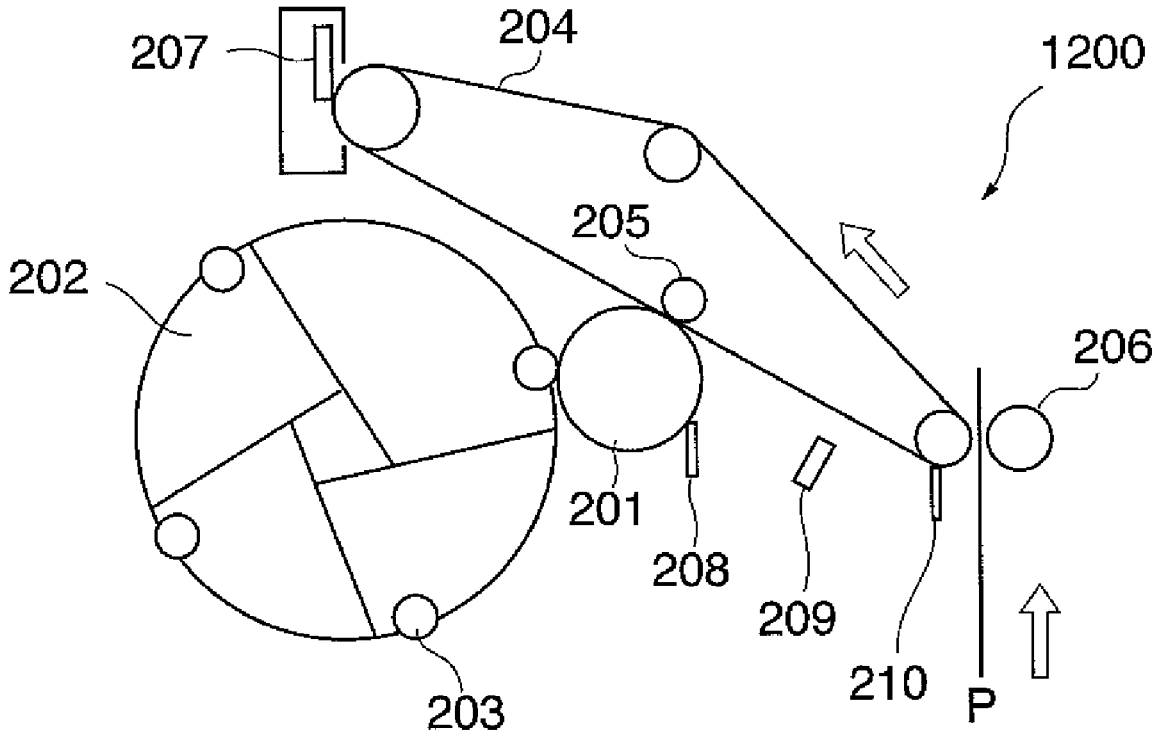
FIG. 12 is a view showing the configuration of a main section of an image forming section included in an image forming apparatus according to a third embodiment of the present invention.

FIG. 12 is a view showing the configuration of a main section of an image forming section included in the image forming apparatus according to the third embodiment.

A one drum type color image forming apparatus 1200 as the image forming apparatus according to the third embodiment includes a photosensitive drum 201, a developing device 202 for developing images of respective colors, sleeves 203, an intermediate transfer belt (intermediate transfer member) 204, a primary transfer roller 205, and a secondary transfer roller 206. The one drum type color image forming apparatus 1200 also includes a cleaning blade 207, a blade 208, a photosensor 209, and a cleaning blade 210.

The photosensitive drum 201 is irradiated with laser light corresponding to image data signals from a laser scanner (not shown). An electrostatic latent image formed on the photosensitive drum 201 reaches the position of the sleeve 203 of any one color in the developing device 202 for four colors by rotation of the photosensitive drum 201 in a clockwise direction.

Toner particles corresponding to the potential between the surface of the photosensitive drum 201 bearing the electrostatic latent image and a sleeve surface of the sleeve 203 to which a developing bias is applied are sprayed onto the surface of the photosensitive drum 201 from the developing device 202, and the electrostatic latent image formed on the surface of the photosensitive drum 201 is developed.

A toner image formed on the photosensitive drum 201 is transferred onto the intermediate transfer belt 204 which rotates in a counterclockwise direction by rotation of the photosensitive drum 201 in the clockwise direction. In the case of a plurality of images of a single color of BK, the images are sequentially formed onto the intermediate transfer belt 204 at predetermined time intervals and primarily transferred by the primary transfer roller 205.

In the case of a full-color image, electrostatic latent images corresponding to respective colors on the photosensitive drum 201 are developed by sequentially positioning the sleeves of the respective colors of the developing device, and resultant images are primarily transferred. Same processing of the above development and primary transfer are repeated for each color. After four rotations of the intermediate transfer belt 204, i.e., at the end of primary transfer for the four colors, primary transfer of the full-color image is completed.

A transfer sheet P is conveyed in the direction of a fixing device (not shown) while it is sandwiched between the secondary transfer roller 206 and the intermediate transfer belt 204 and is attached to the intermediate transfer belt 204 by pressure. A toner image on the intermediate transfer belt 204 is secondarily transferred onto the transfer sheet P.

Note that the cleaning blade 207 capable of abutting against and being separated from the surface of the intermediate transfer belt 204 is placed to toner left on the intermediate transfer belt 204 after the transfer without being transferred onto the transfer sheet P and that the toner is scraped off from the surface of the intermediate transfer belt 204. As described above, the surface of the intermediate transfer belt 204 is cleaned by post-processing control in the second half of the image forming sequence.

In a photosensitive drum unit including the photosensitive drum 201 and blade 208, residual toner is scraped off from the surface of the photosensitive drum 201 by the blade 208 and is conveyed to a waste toner box (not shown) integrated with the photosensitive drum unit.

The photosensor 209 is arranged between the primary transfer roller 205 and the secondary transfer roller 206 to detect a correcting pattern transferred onto the intermediate transfer belt 204. The cleaning blade 210 for cleaning only a correcting pattern is arranged slightly upstream of the secondary transfer roller 206. The cleaning blade 210 and secondary transfer roller 206 are capable of abutting against and being separated from the surface of the intermediate transfer belt 204 by a pulse motor (not shown).

The one drum type color image forming apparatus 1200 with the above-described configuration also can achieve the same advantages as those of the first and second embodiments by color misregistration detecting described in the first and second embodiments.

It is to be understood that the object of the present invention may also be accomplished by supplying a system or an apparatus with a storage medium in which a program code of software which realizes the functions of the above described embodiments is stored, and causing a computer (or CPU or MPU) of the system or apparatus to read out and execute the program code stored in the storage medium.

In this case, the program code itself read from the storage medium realizes the functions of any of the embodiments described above, and hence the program code and the storage medium in which the program code is stored constitute the present invention.

Examples of the storage medium for supplying the program code include a floppy disk, a hard disk, a magnetic-optical disk, an optical disk such as a CD-ROM, a CD-R, a CD-RW, a DVD-ROM, a DVD-RAM, a DVD-RW, or a DVD+RW, a magnetic tape, a nonvolatile memory card, and a ROM. Alternatively, the program code may be downloaded via a network.

Further, it is to be understood that the functions of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of the above described embodiments may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2006-165062 filed Jun. 14, 2006, which is hereby incorporated by reference herein in its entirety.

What is claimed is:

1. An image forming apparatus which forms a toner image with a plurality of color toner comprising:

a toner image forming unit adapted to form the toner image on an image bearing member on the basis of an input image information signal from an external device;

an image detecting unit adapted to detect the toner image formed on the image bearing member and to output a first data obtained by the detection; and a control unit adapted to calculate a second data from the input image information signal, and compare the first data output by said image detecting unit with the second data calculated by said calculating unit to determine, on the basis of the comparison result, whether or not color misregistration occurs in the toner image with the plurality of color toner on the image bearing member, wherein said control unit carries out a color misregistration correction processing of the toner image in the case where said control unit determines that the color misregistration occurs, wherein the detection by said image detecting unit and the calculation by said calculating unit are operated in a predetermined area set on the basis on the input image information signal from the external device, and wherein said control unit sets a portion including the toner image formed by the plurality of color toner on the basis of the input image information signal from the external device as the predetermined area.

2. The image forming apparatus as claimed in claim 1, wherein the first data includes a first width of the toner image detected by said image detecting unit, and the second data includes a second width of the toner image calculated from the input image information signal; and wherein said control unit compares the first width with the second width during the determination.

3. The image forming apparatus as claimed in claim 2, wherein said control unit determines that the color misregistration occurs in the case where a difference between the first width and the second width exceeds a predetermined value.

4. The image forming apparatus as claimed in claim 1, wherein said control unit determines a timing to correct the color misregistration on the basis of the comparison result.

5. The image forming apparatus as claimed in claim 1, wherein the predetermined area is a portion of the toner image which is detectable by said image detecting unit.

6. The image forming apparatus as claimed in claim 1, wherein said control unit sets a portion of the toner image having a density not less than a predetermined density as the predetermined area.

7. The image forming apparatus as claimed in claim 1, wherein said control unit sets a portion of the toner image having a width not less than a predetermined width as the predetermined area.

8. The image forming apparatus as claimed in claim 6, wherein said control unit inhibits operating the detection by said image detecting unit and the calculation by said calculating unit in the predetermined area, in the case where the portion set as the predetermined area has a density more than the predetermined density at each end of the area.

9. The image forming apparatus as claimed in claim 1, wherein said control unit sets a plurality of areas as the predetermined area.

10. The image forming apparatus as claimed in claim 1, wherein said control unit carries out color misregistration correction processing of the toner image before a transfer unit transfers the toner image formed in the predetermined area onto the recording medium in the case where said control unit determines that the color misregistration occurs.

11. An image forming apparatus which forms a toner image with a plurality of color toner comprising:

a toner image forming unit adapted to form the toner image on an image bearing member on the basis of an input image information signal from an external device;

an image detecting unit adapted to detect the toner image formed on the image bearing member and to output a first data obtained by the detection; and a control unit adapted to calculate a second data from the input image information signal, and compare the first data output by said image detecting unit with the second data calculated by said calculating unit to determine, on the basis of the comparison result, whether or not color misregistration occurs in the toner image with the plurality of color toner on the image bearing member, wherein said control unit carries out a color misregistration correction processing of the toner image in the case where said control unit determines that the color misregistration occurs, wherein the detection by said image detecting unit and the calculation by said calculating unit are operated in a predetermined area set on the basis on the input image information signal from the external device, and wherein said control unit sets a portion including the toner image formed by a black toner and at least one color toner other than the black toner on the basis of the input image information signal from the external device as the predetermined area.

12. The image forming apparatus as claimed in claim 11, wherein the first data includes a first width of the toner image detected by said image detecting unit, and the second data includes a second width of the toner image calculated from the input image information signal, and wherein said control unit compares the first width with the second width during the determination.

13. The image forming apparatus as claimed in claim 12, wherein said control unit determines that the color misregistration occurs in the case where a difference between the first width and the second width exceeds a predetermined value.

14. The image forming apparatus as claimed in claim 11, wherein said control unit determines a timing to correct the color misregistration on the basis of the comparison result.

15. The image forming apparatus as claimed in claim 11, wherein the predetermined area is a portion of the toner image which is detectable by said image detecting unit.

16. The image forming apparatus as claimed in claim 11, wherein said control unit sets a portion of the toner image having a density not less than a predetermined density as the predetermined area.

17. The image forming apparatus as claimed in claim 11, wherein said control unit sets a portion of the toner image having a width not less than a predetermined width as the predetermined area.

18. The image forming apparatus as claimed in claim 16, wherein said control unit inhibits operating the detection by said image detecting unit and the calculation by said calculating unit in the predetermined area, in the case where the portion set as the predetermined area has a density more than the predetermined density at each end of the area.

19. The image forming apparatus as claimed in claim 11, wherein said control unit sets a plurality of areas as the predetermined area.

20. The image forming apparatus as claimed in claim 11, wherein said control unit carries out color misregistration correction processing of the toner image before a transfer unit transfers the toner image formed in the predetermined area onto the recording medium in the case where said control unit determines that the color misregistration occurs.

* * * * *